United States Patent [19]

Iwatani et al.

[11] Patent Number: 4,893,951

[45] Date of Patent: Jan. 16, 1990

[54] INK RIBBON POSITIONING SYSTEM FOR COLOR PRINTING APPARATUS

[75] Inventors: Mitsuo Iwatani, Kanagawa; Hiroaki Takano, Tokyo; Masatoshi Mikuriya, Kanagawa, all of Japan

[73] Assignee: Sony Corporation, Tokyo, Japan

[21] Appl. No.: 169,510

[22] Filed: Mar. 17, 1988

[30] Foreign Application Priority Data

Mar. 20, 1987 [JP] Japan ..... 62-65969

[51] Int. Cl.[4] ..... B41J 33/34

[52] U.S. Cl. ..... 400/225; 400/240.3; 400/236

[58] Field of Search ..... 400/240.3, 225, 224.2, 400/227.2, 240.4, 236, 236.2

[56] References Cited

U.S. PATENT DOCUMENTS

| | | | |
|---|---|---|---|
| 4,475,829 | 10/1984 | Goff, Jr. et al. | 400/225 |
| 4,496,955 | 1/1985 | Maeyama et al. | 400/120 |
| 4,562,443 | 12/1985 | Matsuno et al. | 400/224.2 |
| 4,614,950 | 9/1986 | Ito | 400/224.2 |
| 4,632,585 | 12/1986 | Oyamatsu et al. | 400/613 |

FOREIGN PATENT DOCUMENTS

| | | | |
|---|---|---|---|
| 121971 | 10/1984 | European Pat. Off. | 400/236 |
| 0144233 | 12/1985 | European Pat. Off. . | |
| 0174447 | 2/1986 | European Pat. Off. . | |
| 257280 | 12/1985 | Japan | 400/240.3 |
| 31282 | 2/1986 | Japan | 400/240.3 |
| 141579 | 6/1986 | Japan | 400/225 |
| 199972 | 9/1986 | Japan | 400/225 |
| 2147251 | 5/1985 | United Kingdom . | |

*Primary Examiner*—William Pieprz

*Attorney, Agent, or Firm*—Lewis H. Eslinger; Jay H. Maioli; Donald S. Dowden

[57] ABSTRACT

A color ink ribbon positioning system for use with color printing apparatus that uses a color ink ribbon having a plurality of different colored ink regions formed at predetermined intervals on a ribbon base, in which only a single ink region marker block is provided for each set of colored ink regions, includes a detector for detaching the ink region marker block and a calculating unit for determining the leading edge of each color ink region that is to be successively arranged next to the printer head, so that is it only necessary to detect the single marker block in order to advance the ribbon to print the successive colors of a set.

8 Claims, 3 Drawing Sheets

INK RIBBON POSITIONING SYSTEM FOR COLOR PRINTING APPARATUS

BACKGROUND OF THE INVENTION

This invention relates generally to color printing apparatus that performs color printing utilizing a multiple color ribbon that has sequentially arranged thereon a plurality of sets of different colored ink regions and, more particularly, to an ink ribbon positioning system for positioning the desired color of the colored ink region adjacent a printer head for printing.

2. Description of the Background

There is known color printing apparatus that produces a printed color image or printed characters on a printing paper or film or the like. Such color printers have found applications in various fields, for example, in a video printer that can produce a color still image based on a color video signal, such as a color television signal or a color video signal from an electronic still camera, or a thermal printing word processor that has an image scanning function as well. This type of color printing apparatus typically employs a color ink ribbon that is formed of a plurality of colored ink regions generally arranged as sets of colors that are then sequentially arranged along the length of the ribbon. In one proposed color video image printer the color ink ribbon is generally provided with ink regions containing sublimation dyes of yellow Y to produce yellow color images, magenta M to produce a magenta color image, and cyan C for producing a cyan color image as well as black B. Thus, it is seen that the additive color process is being carried out. Generally these ink regions bearing the above four colors are formed in a series, always in the same order, on the elongated strip of the ribbon with each series being successively repeated over the length of the ribbon. In order to enable the color printer to position the desired color of the ink region in opposition to the printer head to form the image on paper or the like, the color ink ribbon is also provided with a number of indicating or marker blocks that can be detected to determine the color presently aligned with the printer head. It should be noted that such printer heads are typically thermal printer heads when utilizing the sublimation dyes described above.

One example of a color ink ribbon as described hereinabove is shown in U.S. Pat. No. 4,558,329 issued Dec. 10, 1985 and assigned to the Assignee hereof. In this patent, a color ink ribbon is proposed for a thermal-transfer printing operation that can produce a hard copy of a still picture, such as might be produced by a video camera or a television picture image or the like. In this patent the color ink ribbon has a plurality of thermally transferrable ink regions of different colors in a predetermined arrangement and with a corresponding plurality of ink region indicator marks. Such indicator marks are typically marker blocks formed on the base material of the ribbon and contain a dispersion dye, binder, and pigment that is thermally stable and have light absorbing properties for absorbing infra-red light. These marker blocks are disclosed as being formed simultaneously with the formation of the actual various colored ink regions of the ribbon.

The colored ink ribbon described in this patent and the associated printing apparatus shown therein have been found to adequately produce color prints, however, as seen in that patent there is the requirement to provide the ink region indicator marker blocks for each ink region in order to permit precise positioning of the colored portions of the ribbon relative to the thermal print head at the time of forming the image. Although such system does produce acceptable images, there are the drawbacks that a substantial amount of material for the ink region marker blocks is required and also the manufacturing time required to produce the color ink ribbons is increased, even when simultaneous processing is provided relative to the formation of the color ink regions. Thus, the production cost of the color ink ribbons is increased by the requirement for the marker blocks at each of the colored ink regions on the ribbon.

OBJECTS AND SUMMARY OF THE INVENTION

Accordingly, it is an object of the present invention to provide a ribbon positioning system for a color printing apparatus that can eliminate the above-noted defects inherent in the prior art.

Another object of the present invention is to provide a color ink ribbon positioning system for a color printing apparatus that requires a reduced number of ink region indicating blocks to be formed on the ribbon and thereby lowers the manufacturing costs of the ink ribbon.

In accordance with an aspect of the present invention, such objects are accomplished by providing a color ink ribbon having a plurality of different color regions formed in a series at predetermined intervals and providing ink region indicator marker blocks that are formed on the ribbon but which indicate only the beginning of each set or sequence of colors. The inventive positioning system also includes a detector system that detects the ink region marker blocks, as well as determining the ribbon feed amount and detecting the leading edge of each color ink region when it is in position relative to the printer head and controlling the printer head operation accordingly so that printing will occur only when the beginning of the ink color region is properly located relative to the printing head.

According to the present invention, the ink ribbon positioning system operates in conjunction with a paper platen on which the printing paper is affixed and a driver motor suitably coupled to the platen to operate it to cause the image to be formed thereon. The ink ribbon according to the present invention has a plurality of different color sets formed thereon with each color set including a number of different color ink regions in the same order and a color set marker is provided at the beginning of each color set on the ink ribbon. The ink ribbon is arranged between a printer head and a platen and is transported between a supply reel and a take-up reel. The printer head is movable between a head-down position in which a printing operation occurs and a head-up position at which time the ink ribbon is advanced to the next color in the set. A head position controller is coupled to the printer head to move the head between the two positions such that during the head-down position the printing paper and the ink ribbon are pressed against the paper platen by means of the printing head in order to accomplish the printer operation. A sensor for detecting the color set marker on the ink ribbon is provided and the positioning of the first color ink region of each color set is performed based upon the detection of the color set marker. A pulse generator coupled to either the ribbon take-up or supply reel produces pulses that are fed to a counter circuit to detect the number of pulses during the printing operation of the first color ink region in the head-down position of the printer head. A calculation circuit is then coupled to the counter to calculate the number of pulses to be generated by the pulse generator in order to position the second color ink region of each color set at the appropriate position based upon the number of pulses counted during the printing operation of the first color region. Thus, a ribbon drive circuit is provided to drive the ink ribbon to position a second color ink region of each color set based upon the results of the calculation of the circuit.

According to another aspect of the present invention, a multiple color printing apparatus having a printer head and a paper platen for supporting a printing paper and performing a line feeding action in synchronism with the printing operation of the printer head assembly is provided. Such apparatus utilizes a multiple color ribbon having a plurality of color ink regions on the ribbon base with the color ink regions of different colors being arranged in predetermined order in a spaced-apart relationship with a first known interval in series, in order to form a color ink region sequence. A number of such color ink regions are arranged in series and are also in spaced-apart relationship with a second known interval between each sequence. The multiple color printing ribbon follows a path between the printing head and the platen from a supply reel to a take-up reel and a system is provided to initially set the color ink ribbon at a predetermined position for commencing a color printing cycle. Feeding of the color ink ribbon is controlled so that the ribbon is fed from a known print-start position to a known print-end position spaced-apart from the print start point by a first known length through one cycle of the color printing operation. A circuit is provided for monitoring the ink ribbon feed length in unit lengths of the ribbon feed and for deriving a reference value that represents the angular displacement magnitude for initially setting the color ribbon for the next cycle of color printing. Based upon the unit ribbon feed length data and a second known length required to feed from the print end position of the leading color ink region to the print end position of the following color ink region. The circuit that initially sets the color ink ribbon is then controlled based upon the derived reference data in order to set the color ink ribbon at the print-start position for the next cycle of the printing operation, that is, for printing the next paper on the platen with the still image.

According to a further aspect of the present invention, a multiple color printing apparatus utilizes a multicolor ribbon having a plurality of color ink regions on a ribbon base, with the color ink regions of different colors being arranged in a predetermined order in spaced-apart relationship with a first known interval between different colors. The color ink region sequences are then arranged in series with adjacent color ink region sequences being in spaced-apart relationship with a second known interval. A marker block is formed on the color ink ribbon that indicates the leading end or beginning of each color ink region sequence. A color ink ribbon path is provided between a take-up reel and a supply reel with a print head being arranged on one side of the path and a paper platen assembly arranged on the other side of the ribbon platen in opposition to the printer head. The paper platen mounts a paper upon which the image is to be formed and that is driven in synchronism with the printing operation of the head for line-by-line construction of the desired image. The ribbon feeding mechanism is also synchronized with the platen assembly when forming the image, so that a fresh portion of the ribbon is available for each successive line making up the image. A ribbon feeding system is provided wherein the color ink region is fed from a known print-start position to a known print-end position separated from the print-start position by a first known length through one cycle of a single color printing operation. A driver mechanism is provided that drives either the supply or take-up reels in synchronism with the ribbon feed and a pulse generator is coupled with either the supply or take-up reel for rotation therewith in order to monitor the angular displacement of that reel and generate a pulse signal at every predetermined increment of angular displacement of the respective reel.

A system controller is provided that controls the operation of the printer head assembly and the line feeding action of the platen and the system controller includes the circuit that counts the pulse signal produced by the pulse generator to obtain reel angular displacement data and derive a unit ribbon feed magnitude that occurs in a period corresponding to the period of the pulse signal based on the first known length and the reel angular displacement data. This circuit then derives a reference value that represents the angular displacement magnitude for initially setting the color ink ribbon for the next cycle of the color printing operation based on the unit ribbon feed magnitude and the known length of feed from the print-end position of the leading color ink region to the print-start position of the following color ink region. A detector is provided that detects the marker block in order to initially set the color ink ribbon at the predetermined position for the first cycle of the color printing operation. The ribbon is then fed to the print-start position of the following color ink region and the angular displacement magnitude of either the take-up or supply reel is monitored in order to stop the ribbon feed at the angular position represented by the reference value for each successive cycle of the color printing operation.

The ribbon feeding system according to the present invention preferably comprises two ribbon feeding approaches, a first cooperates with the platen for feeding the color ink ribbon in synchronism with the line feeding operation of the platen during each cycle of the printing operation, and a second is operable independently of the line feeding action of the platen during the initial setting operation of the marker block detector, with the second feeding mechanism being controlled by the action of the marker block detector in order to position the color ink ribbon at the print start position.

The above and other objects, features, and advantages of the present invention will become apparent from the following detailed description of illustrative embodiments thereof, to be read in conjunction with the accompanying drawings in which like reference numerals indicate the same or similar elements.

DETAILED DESCRIPTION OF PREFERRED EMBODIMENTS

Figure 1:
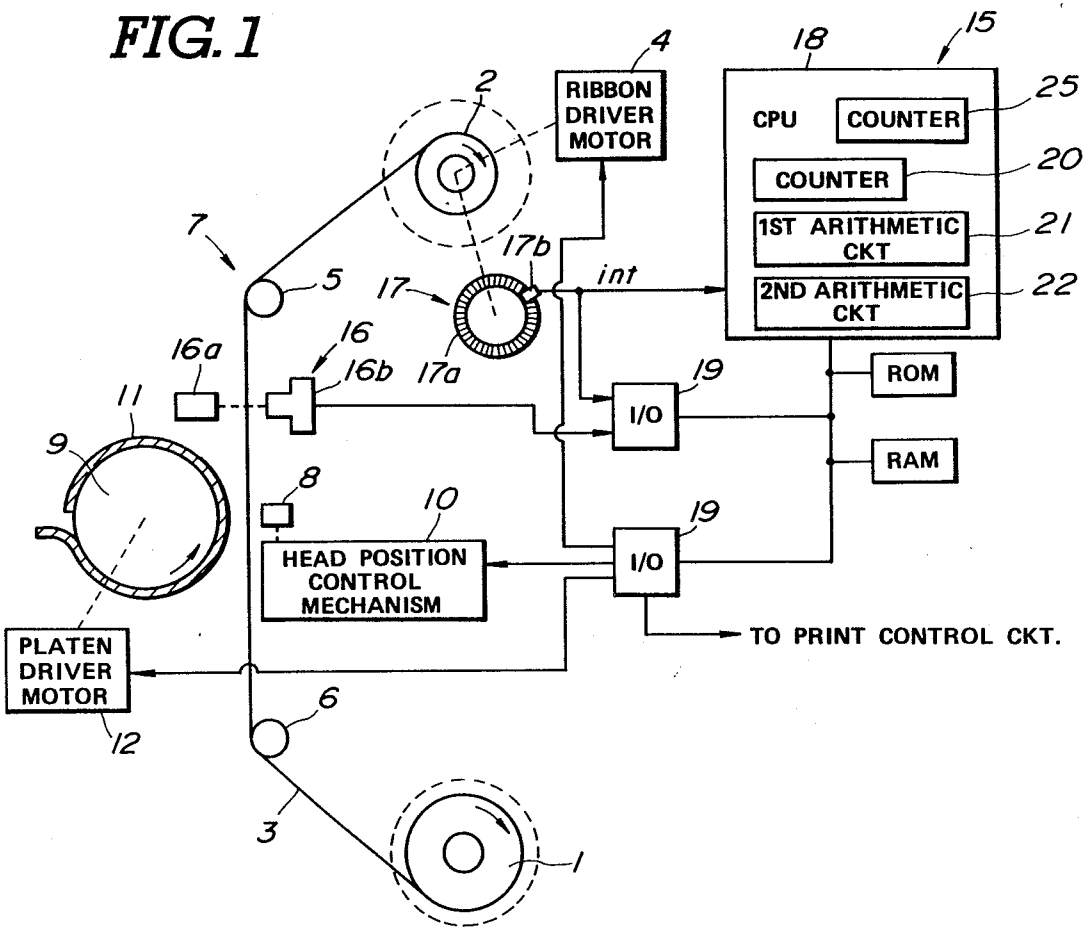
FIG. 1 is a schematic block diagram of a color ink ribbon positioning system utilized in a color printing apparatus according to an embodiment of the present invention.

FIG. 1 schematically shows a color printing apparatus in which a color ink ribbon 3 is supplied from a supply reel 1 to a take-up reel 2. In this embodiment the supply reel is free to rotate whereas the take-up reel is driven by a ribbon drive motor 4. Ribbon guides 5 and 6 are arranged between take-up reel 2 and supply reel 1 and define a ribbon path 7 through which color ink ribbon 3 is fed. On opposite sides of the ribbon paths 7 are a thermal printing head 8 and a platen 9. Thermal printing head 8 is under the control of a head position control mechanism 10 that serves to operate thermal printer head 8 between a head-down position, in which thermal printer head 8 contacts color ribbon 3, and a head-up position, in which thermal printer head 8 is pulled away from color ink ribbon 3. Platen 9 is provided to support a printing paper (not shown) on which the image is to be formed, and platen 9 is driven by a platen driver motor 12 to incrementally rotate platen 9 in a line-by-line feeding operation relative to thermal printing head 8 as is well-known and, as is shown for example in U.S. Pat. No. 4,558,329, thermal printing head 8 provides a line-by-line printing operation.

Figure 2:
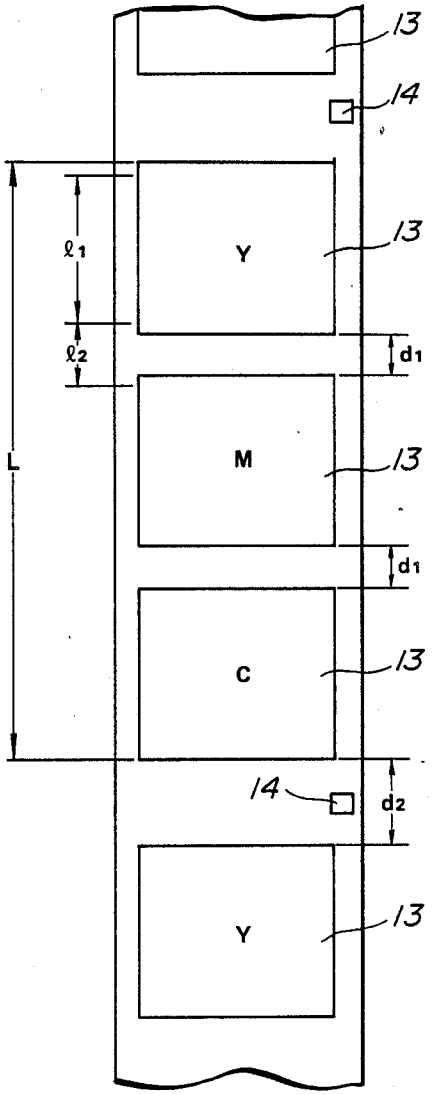
FIG. 2 is a pictorial representation of a color ink ribbon according to the present invention and as utilized in the system of FIG. 1.

The construction of the ribbon intended for operation with the present invention is represented in FIG. 2, in which the color ink ribbon is formed with the plurality of color ink regions 13 arranged as sets, with each set containing sublimation dyes of different colors. Color ink regions 13 are arranged in series on an elongated strip of base material to form the ribbon. In this particular embodiment, color additive printing is involved in which a yellow ink region 13 is denoted as Y, a magenta ink region 13 is denoted as M, and a cyan ink region 13 is denoted as C, all such regions being arranged in series in order to comprise a color ink region sequence or color set spanning distance L. This set is repeated over the length of the ribbon. The composition or material employed in the sublimation dyes for forming the respective ink regions Y, M, and C can be the same as described in U.S. Pat. No. 4,558,329 identified hereinabove. Accordingly, the disclosure of U.S. Pat. No. 4,558,329, to the extent required to complete the instant application, is herein-incorporated by reference.

As shown in FIG. 2, each color ink region 13 that makes up a set or sequence is in spaced-apart relationship with the other color ink region in the set by a distance $d_1$. Furthermore, each successive color ink region sequence L is separated from each other by an interval corresponding to distance $d_2$, that is, the last color region 13 of a set is separated from the first color region 13 of the next set by distance $d_2$. Furthermore, interval or distance $d_2$ is greater than interval $d_1$.

According to this invention, a region marker block 14 is formed in interval $d_2$ between successive color ink sets L. Color ink region marker block 14 may be optically detectable in order to perform ribbon position control. For example, such optical detectable region marker block 14 might be formed of a light reflective material, or marker block 14 might be formed of an infra-red ray absorbing material, similar to that disclosed in U.S. Pat. No. 4,558,329. In the embodiment of FIG. 2, marker block 14 comprises either an aperture or transparent window formed in the ribbon at the appropriate position within interval $d_2$ between the color ink region sets L.

Referring back to FIG. 1, an optical sensor 16 is connected to a system controller 15 through an input/output (I/O) interface 19 for detecting marker block 14 and optical sensor 16 comprises a light source 16*a* and a light detector 16*b* optically aligned therewith.

System controller 15 is also connected to a pulse generator 17 that generates ribbon feed pulses corresponding to angular increments of rotation of take-up reel 2. More specifically, system controller 15 may comprise a central processing unit 18 that includes the functional blocks represented by a counter 20, a first arithmetic unit 21, and a second arithmetic unit 22. As is well-known, in forming a so-called microprocessor system associated with central processing unit (CPU) 18 a read only memory (ROM) 23, a random access memory (RAM) 24, and one or more input/output interface units 19 and 19' would typically be involved.

In the operation of optical sensor 16, the light emitting element or light source 16*a* and light detector 16*b* are arranged in optical alignment with each other on opposite sides of ribbon path 7 to detect color ink region marker block 14 and determine when the leading edge of the color ink region set L, that is, when the leading edge of the yellow color ink region 13 is in the correct position opposite thermal printing head 8. The detection signal produced by light detector 16 when a color ink region marker block 14 is detected is fed to system controller 15 through input/output interface unit 19.

On the other hand, pulse generator 17 is formed as a disc-shaped rotary body 17*a* in combination with a sensor or detector element 17*b*. Rotary body 17*a* is affixed to a rotary shaft or axle of take-up reel 2, which is driven by ribbon drive motor 4, so as to cause sensor body 17*a* to rotate with take-up reel 2. Sensor body 17*a* can have various configurations, however, an advantageous construction is to include a plurality of openings and opaque portions alternately arranged so that a light beam on the periphery of sensor body 17*a* is broken and can be sensed by sensor 17*b*. The number of alternate transparent and opaque segments on body 17 can determine the degree of accuracy by which angular displacements of the sensor body can be detected, that is, the angle subtended by each clear segment determines the resolving power of pulse generator 17. Accordingly, a pulse is produced at each predetermined increment of angular displacement of the rotary sensor body 17*a*, which pulse is fed to system controller 15 by way of the INT terminal of central processing unit 18 and this pulse is also fed through input/output interface unit 19. Counter 20 is arranged as a count-up counter that counts the pulses fed into the INT terminal during the printing operation, when thermal head 8 is in the head-down position and the lines of the image are being formed on the paper, and also counts the signal pulses fed in to central processing unit 18 by way of I/O interface unit 19 during all other times. First arithmetic circuit 21 derives a unit length S of ribbon to be fed during a pulse interval of consecutive pulse signals based upon value $N_1$ that has been counted by counter 20 during the printing operation according to the following:

$$S = l_1/N_1 \quad (1)$$

where $l_1$ is the longitudinal length of ribbon fed during the time thermal printing head 8 is maintained in operation to form the image.

It will be understood that derivation of the unit ribbon feed length S per increment of angular rotation of take-up reel 2 and the subsequent updating of this value is necessary because the diameter of ribbon wound on the take-up reel 2 as the printing operation proceeds will increase and, thus, the number of so-called pulses needed to advance the ribbon a known distance will also vary.

Second arithmetic circuit 22 is provided to derive the number $N_2$ of signal pulses counted in counter 20 at the position corresponding to the leading edge of the desired color ink region 13 based upon the derived unit ribbon feed length S and the dimensions of the ribbon, which are known and held to reasonable tolerances. The longitudinal length $l_2$ is the region of ribbon advance where thermal printing head 8 is held in its inoperative state. More particularly, the count $N_2$ of the pulses is determined by:

$$N_2 = l_2/S \quad (2)$$

System controller 15 then controls the operation of the color printing apparatus based upon the detected position of the color ink ribbon 3. The manner in which such control of the operation of the color printing apparatus is performed according to the embodiment of FIG. 1 is represented by the flowchart as shown in FIG. 3.

Figure 3:
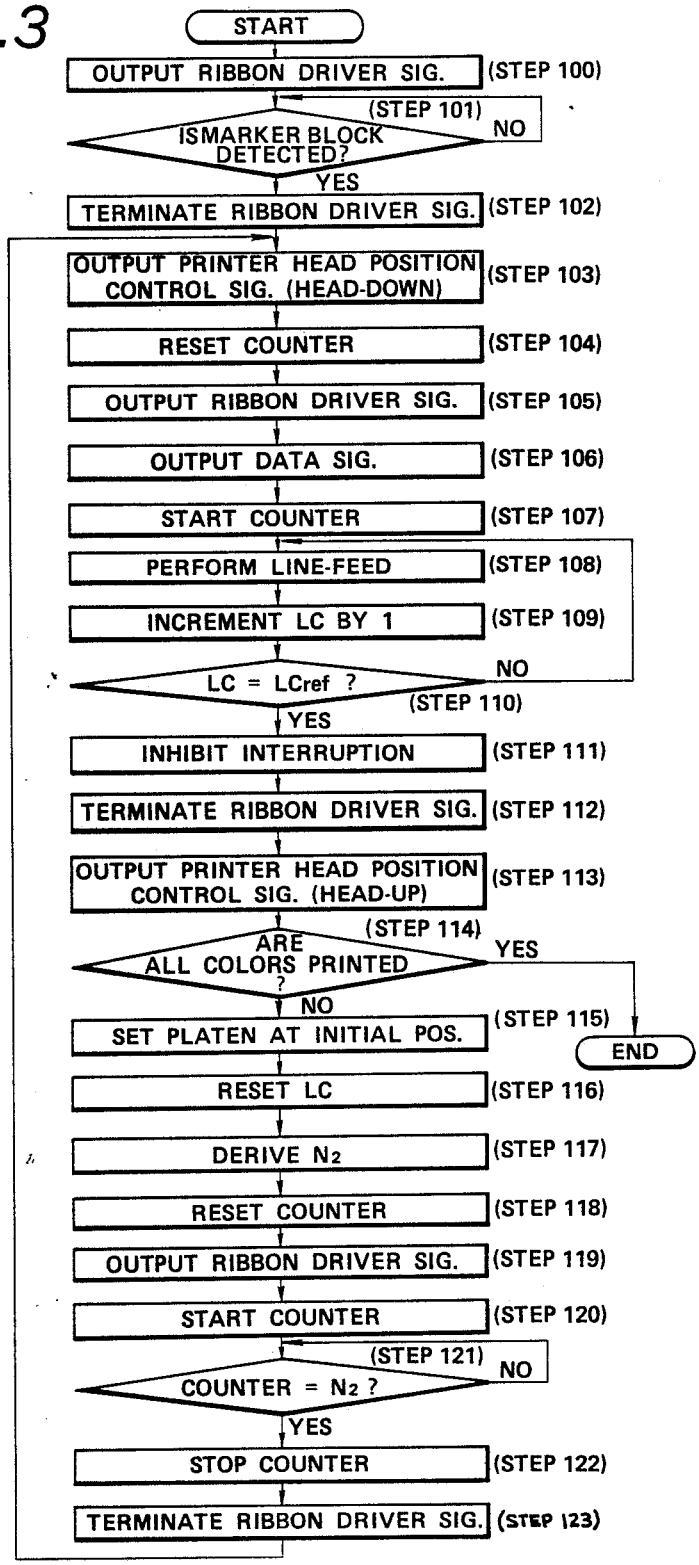
FIG. 3 is a flowchart showing the process of the color printing operation that is performed by the apparatus of FIG. 1.

In commencing the operation represented in FIG. 3, a suitable print command button (not shown) in the color printing apparatus is depressed that immediately starts the process and central processing unit 18 produces a ribbon driver signal fed out through I/O unit 19', as represented in step 100. This operates ribbon drive motor 4 to cause take-up reel 2 to drive color ink ribbon 3 through ribbon path 7. Although the process of FIG. 3 appears continuous, it will be appreciated that the process is interrupted upon each occurrence of a pulse from pulse generator 17 so that such pulse can be counted, and this interruption is done according to the well-known interrupt processing routine executed by the central processing unit 18.

While color ink ribbon 3 is being fed along the ribbon path 7, optical sensor 16 operates to detect color ink region marker block 14 on ribbon 3 and upon such detection produces a signal fed back through I/O unit 19 that is looked for by central processing unit 18 as seen at step 101. Upon detecting marker block 14 central processing unit 18 terminates the ribbon driver signal, as represented in step 102. .If marker block 14 is not detected the ribbon drive signal is continued until it is. By way of this process, color ink ribbon 3 is set at an initial position and during the period in which the ribbon is being initially set, thermal printer head 8 is held in the so-called head up position. Thus, the printing operation can not take place during the initial ribbon setting period. Thereafter, central processing unit 18 produces a printer head position control signal fed through I/O unit 19' to operate head position control mechanism 10, as represented at step 103. Head position control mechanism 10 then drives thermal printing head 8 to the head-down position. In this position, thermal printer head 8 comes into contact with color ink ribbon 3. Then, at step 104 central processing unit 18 resets counter 20 to clear the counter value. The ribbon driver signal is again produced at step 105 to cause ribbon drive motor 4 to cause take-up reel 2 to move and take up the ribbon that is used up in the line-by-line printing operation and as take-up reel 2 moves rotary sensor body 17*a* of the pulse generator 17 also rotates. It must be noted, however, that during the head-down position, that is, during the time that the actual line-by-line printing operation is underway the advance of ribbon 3 is under control or is managed by the rotation of platen 9. In other words, the ribbon is advanced during the printing operation in synchronism with or under the control of the system that causes the printing paper to be advanced in a line-by-line fashion and drive motor 4 and take-up reel 2 cooperate to take up the expended ribbon.

The data to be printed is fed to thermal printing head 8 at step 106 from central processing unit 18 and, in the instant embodiment as shown in FIG. 2, the first color ink region 13 to be printed is the yellow color Y and, thus, yellow color image or character data is fed to thermal printer head 8. Step 107 then involves the central processing unit 18 enabling or triggering counter 20 to count up the pulses produced by pulse generator 17 that are fed in through input terminal INT. In addition, at step 108, central processing unit 18 then outputs a platen driver signal through I/O unit 19' to platen driver motor 12 to cause the amount of angular displacement of platen 9 necessary to accomplish the line feeding operation.

In this embodiment, thermal printing head 8 comprises a line printer having a number of thermal elements arranged in a linear alignment along a horizontal scanning line for printing one color of one horizontal scan line image on the paper at each printing operation, that is, each time the data is fed to the print head. After the printing of one line, central processing unit 18 outputs a pulsed platen drive signal to drive platen 9 through a predetermined angle of rotation, which corresponds to the interval between adjacent print lines of the image. After outputting the platen drive signal, central processing unit 18 then increments a line counter (not shown) by one, as represented at step 109. The value LC in the line counter is then compared with a preset reference value that represents the number of horizontal scan lines of one field of the image or character data, which is represented in comparison step 110. This operation is, of course, to determine whether or not all the lines of one field have been printed and, if not, the next successive line is then printed and it is again checked to determine whether that is the last line of the field. In the embodiment contemplated herein, one image field is comprised of 720 horizontal scan lines and, thus, the preset value $LC_{ref}$ is 720.

As described above, ribbon drive motor 4 is driven to take-up the color ribbon during the printing operation so that a new or unused ink portion is presented to the print head for each line of the print operation and, thus, drive motor 4 causes ribbon 3 to advance by a length corresponding to the magnitude of angular rotation of platen 9. Therefore, the feed length $l_1$ of ribbon 3 through one field of the image then corresponds to the total magnitude of the angular displacement of the platen. Because the number of line shifts for one image field is known, in this example it is 720, and because the magnitude of the angular displacement of the platen for each line shift operation is known, then the total ribbon feed length $l_1$ for that color image can also be determined.

The printing operation steps of 108, 109, and 110 are then repeated until the line counter value LC reaches the preset value $LC_{ref}$. Then, central processing unit 18 enters an interrupt inhibiting state so as not to allow execution of the interrupt routine for incrementing the count in counter 20, as represented at step 112. The ribbon driver signal is then terminated at step 112 and the drive operation of ribbon drive motor 4 is stopped. The printer head position control signal is produced by central processing unit 8 and fed through I/O unit 19 to head position control mechanism to release thermal printing head 8 from color ink ribbon 3 and to place it in the head-up position, at step 113. Thereafter, central processing unit 18 checks whether all color images have been printed or not, at step 114. If not, platen driver signal is output to the platen driver motor 12 to drive platen 9 in the reverse direction continuously to return platen 9 to its initial position in preparation for printing the next color image, as represented at step 115. At substantially the same time, in step 116, the line counter value LC is reset to zero.

First arithmetic circuit 21 was described above to derive the unit ribbon feed length S and, thus, at step 117 central processing unit 8 operating as first arithmetic circuit 21 performs the necessary arithmetic operation to derive the unit ribbon feed length S based on counter value $N_1$. Because the total ribbon feed length $l_1$ for each color image is known from the number of line feeds necessary for one field of the image and the magnitude of the angular displacement of the platen for each line shift, then the unit ribbon feed length S corresponding to one pulse period can be calculated by dividing the known total ribbon feed length $l_1$ by the counter value $N_1$.

Because central processing unit 18 also serves as the second arithmetic circuit 22, step 117 is also the step in which the frequency signal pulse number for feeding color ink ribbon 3 to the next print start position of the next color ink portion is derived. More specifically, because the distance represented by feed length $l_2$ from the printing end position of one color to the printing start position of the next color of that set is known, as represented in FIG. 2, the number $N_2$ of pulses necessary to feed color ink ribbon 3 to the print start point of the next color can be calculated by dividing the known length $l_2$ by the unit ribbon feed length S. This value $N_2$ derived by the arithmetic operation in step 117 is temporarily stored in a temporary register (not shown) in system control unit 15. Next, at step 118, counter 20 is reset to clear the counter value to zero and the ribbon driver signal is output to ribbon drive motor 4 to start feeding color ink ribbon 3, as represented at step 119. At step 120, counter 20 is triggered to begin counting once again the pulses produced by pulse generator 17 that are fed through the I/O interface unit 19. Step 121 represents the comparison of the count value in counter 20 with the derived number $N_2$ and as long as the counter value is less than the number $N_2$ then step 121 is repeated until the counter reaches $N_2$, at which time the counting operation of counter 20 is stopped, as represented in step 122. Once that occurs, the ribbon driver signal is then terminated and ribbon drive motor 4 is stopped as represented at step 123.

Therefore, as can been seen, performance of the steps denoted as 117 through 123 serves to provide an initial setting of color ink ribbon 3 for the printing of the next ink region. After completing the initial setting of the ribbon, the process then returns to step 103 to commence printing the next color. For example, in the embodiment shown herein, the color printing for the magenta color M utilizing magenta color ink region 13 is performed by printing steps 104 through 116. Subsequent to printing the magenta color M then the initial setting for the cyan color C printing utilizing cyan color ink region 13 must take place.

Because the embodiment of the present invention requires only one color ink region marker block 14 for each color ink sequence L the time required to form the color ink region sequence can be substantially shortened. In addition, although the instant embodiment employs frequency generator 17 associated with take-up reel 2, it is also possible to couple the frequency generator to the supply reel to accomplish the same results. Furthermore, although in this embodiment a line-type thermal printing head was employed to print one horizontal scan line at a time, the present invention is also applicable to color print apparatus that employs a thermal printing head unit in which the number of dots in the printing head is less than the number of dots in a line, in which case the line shifting operation may be performed by detecting when the printer head is at the end of the horizontal scanning motion.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. An ink ribbon positioning system for a color printing apparatus, comprising:

a paper platen on which a printing paper is arranged;

a platen driver motor coupled to said platen;

an ink ribbon having a plurality of color sets, each color set having a plurality of color ink regions and a color set marker provided at a beginning of each of said color sets on the ink ribbon;

a take-up reel and a supply reel for transporting said ink ribbon therebetween, said ink ribbon being wound on each of said reels with winding diameters that change during said transporting;

a printer head movable between a head-down position and a head-up position;

head control means coupled to said printer head for moving said printer head between said head-down position and said head-up position, said printing paper and said ink ribbon being pressed against said paper platen by said printer head at said head-down position of said printer head for performing a printing operation;

a sensor for detecting said color set marker of said ink ribbon, whereby a positioning of said first color ink region of said each color set to a print start position is performed in response to detection of said color set marker;

a pulse generator coupled to one of said take-up and supply reels;

a counter circuit connected to said pulse generator for counting the number of pulses $N_1$ during said printing operation of said first color ink region over a constant length $l_1$, at said head-down position of said printer head, whereby said counter circuit produces a variable output based on $N_1$ and $l_1$;

a calculation circuit responsive to the variable output of said counter circuit for calculating a number of pulses $N_2$ to be generated by said pulse generator for positioning a second color ink region of the each color set to said print start position and producing an output signal based on the calculation; and an ink ribbon drive circuit for causing said take-up reel and supply reel to transport said ink ribbon to position a second color ink region of said each color set in response to the output signal from said calculation circuit, said second color ink region being displaced from said first color ink region by a constant distance $l_2$;

wherein $N_1$ and $N_2$ are updated during said transporting in view of changes in said winding diameters.

2. A multi-color printing apparatus having a printer head assembly for printing and a paper platen assembly for supporting a printing paper and performing line feeding action in synchronism with a printing operation of said printer head assembly, said apparatus utilizing a multi-color ribbon having a plurality of color ink regions and a color set marker on a ribbon base, said color ink regions of different colors being arranged in a predetermined order in spaced-apart relationship with a respective first known interval therebetween in series to form a color ink region sequence, said color ink region sequence being arranged in series with an adjacent color ink region sequence in spaced-apart relationship with a second known interval therebetween, said multi-color printing apparatus comprising:

first and second ribbon reels, said multi-color ribbon being wound on each of said reels with winding diameters that change during said printing operation;

first means for defining a path of said multi-color ribbon for transferring the latter therethrough from said first ribbon reel to said second ribbon reel;

second means for initially setting said color ink ribbon at a predetermined position for a subsequent color printing cycle by driving said first and second ribbon reels through angular distances that are updated during said printing operation in view of changes in said winding diameters;

third means for feeding said multi-color ribbon through said ribbon path, said third means feeding said color ink ribbon from a known print-start position determined with reference to said color set marker to a known print-end position spaced from said print-start position by a first constant length $l_1$ through one cycle of the color printing operation;

fourth means for monitoring a ribbon feed length in a predetermined unit period for obtaining unit ribbon feed length data; and fifth means for deriving a reference value which represents a magnitude of angular displacement for an initial setting of said color ink ribbon for a next successive cycle of color printing, based on said unit ribbon feeding length data and a known length of feed from said print-end position of a leading color ink region to a print-start position of a following color ink region displaced from said print-end position of said leading color ink region by a constant distance $l_2$, said fifth means controlling said second means based on said reference data, thereby causing said second means to drive said first and second ribbon reels to set said color ink ribbon at said print-start position for a next cycle of the printing operation.

3. A multi-color printing apparatus as set forth in claim 2, wherein said color set marker is arranged adjacent the leading end of each color ink region sequence for indicating the print-start position of the first color ink region for first color printing in a sequence of color printing cycles, and said second means detects said marker block for setting said color ink ribbon at said print-start position of said first color ink region.

4. A multi-color printing apparatus as set forth in claim 3, wherein said fourth means comprises a pulse generator generating a constant pulse width pulse train and a pulse counter for counting pulses of said pulse train, while said color ink ribbon is transferred from said print-start position to said print-end position in one cycle of color printing operation, and deriving said unit ribbon feed length based on said first known length and the value in said counter.

5. A multi-color printing apparatus as set forth in claim 2, wherein said third means comprises a first feeding means cooperative with said platen for feeding said color ink ribbon in synchronism with a line feeding operation of said platen during each cycle of the printing operation, and a second feeding means operable independently of said line feed action of said platen during an initial setting operation of said second means, said second feeding means being controlled by said second means so as to position said color ink ribbon at said print start position.

6. A multi-color printing apparatus as set forth in claim 4, wherein said pulse generator comprises a frequency generator coupled with one of said first and second ribbon reels so as to be rotatingly driven with the associated one of said first and second reels for generating a pulse at every predetermined angular rotation thereof.

7. A multi-color printing apparatus utilizing a multi-color ribbon having a plurality of color ink regions and a color set marker on a ribbon base, said color ink regions comprising different colors arranged in a predetermined order in spaced-apart relationship with a respective first known interval therebetween to form a color ink region sequence, a plurality of said color ink region sequences being arranged in series in spaced-apart relationship with a respective second known interval therebetween, and said multi-color ink ribbon having a single marker block indicative of the leading end of a color ink region sequence, said multi-color printing apparatus comprising:

first means for defining a ribbon path of said multi-color ribbon for transfer from a first reel to a second reel during a printing operation, said multi-color ribbon being wound on each of said reels with winding diameters that change during said printing operation;

a printer head assembly provided at one side of said ribbon path;

a paper platen assembly provided at another side of said ribbon in opposition to said printer head across said ribbon path, said paper platen assembly driving a printing paper in synchronism with said printing operation for line-by-line feeding of said printing paper;

ribbon feeding means for feeding said multi-color ribbon through said ribbon path, said ribbon feeding means feeding said color ink region from a known print-start position determined with reference to said color set marker to a known print-end position spaced apart from said print-start point by a first constant length $l_1$ of ribbon through one cycle of single color printing operation;

reel driver means associated with one of said first and second reels for rotatingly driving the associated one of first and second reels in synchronism with said ribbon feeding;

pulse generator means coupled with said one of first and second reels associated with said reel driver means for rotation therewith and generating a pulse signal at every predetermined amount of angular displacement of said associated reel; and system controller means for controlling operation of said printer head assembly and said line feeding action of said platen, said system controller means including first means for counting pulses $N_1$ and $N_2$ of said pulse signal from said pulse generator means for respectively (i) obtaining reel angular displacement data and deriving a unit ribbon feeding magnitude in a period corresponding to the period of said pulse signal on the basis of said first known length and said reel angular displacement data and (ii) deriving a reference value which represents an angular displacement magnitude for initially setting said color ink ribbon for a next cycle of single color printing based on said unit ribbon feeding magnitude and a second constant length $l_2$ from said print-end position of a leading color ink region to a print-start position of a following color ink region, second means for detecting said marker block for initially setting said color ink ribbon at a predetermined position for a subsequent first cycle of color printing operation, and third means connected to said reel driver means for driving one of said first and second reels and feeding said ribbon to said print-start position of said following color ink region and monitoring the angular displacement magnitude of said associated reel, so that feeding of said ribbon is stopped at the angular position represented by said reference value for second and succeeding cycles of the color printing operation;

wherein $N_1$ and $N_2$ are updated during said printing operation in view of changes in said winding diameters.

8. A multi-color printing apparatus as set forth in claim 7, wherein said ribbon feeding means comprises a first feeding means cooperative with said platen for feeding said color ink ribbon in synchronism with the line-by-line feeding operation of said platen during each cycle of the printing operation, and a second feeding means operable independently of said line-by-line feeding action of said platen during initial setting operation of said second means, said second feeding means being controlled by said second means so as to position said color ink ribbon at said print start position.

* * * * *

UNITED STATES PATENT AND TRADEMARK OFFICE

CERTIFICATE OF CORRECTION

PATENT NO. : 4,893,951

DATED : January 16, 1990

INVENTOR(S) : Mitsuo Iwatani, Kanagawa

It is certified that error appears in the above-identified patent and that said Letters Patent is hereby corrected as shown below:

In the Abstract, line 6, change "detaching" to --detecting-- line 10, change "is it" --it is--

Col. 1, line 5 after "BACKGROUND OF THE INVENTION"

next line insert --1. Field of the Invention--

Col. 7, line 49, delete "." second occurence

In the Claims:

Col. 10, line 33, after "each" insert --said--

Signed and Sealed this

Nineteenth Day of February, 1991

*Attest:*

*Attesting Officer*

HARRY F. MANBECK, JR.

*Commissioner of Patents and Trademarks*